US010161635B2

(12) United States Patent
Pinnick et al.

(10) Patent No.: US 10,161,635 B2
(45) Date of Patent: Dec. 25, 2018

(54) COMBUSTOR WITH SPRING-LOADED CROSSOVER TUBES

(71) Applicant: Rolls-Royce Corporation, Indianapolis, IN (US)

(72) Inventors: Donald E. Pinnick, Mooresville, IN (US); Kevin M. Sauer, Plainfield, IN (US); Russell N. Bennett, Indianapolis, IN (US); Bradley A. Lemke, Avon, IN (US); Caleb Camara, Indianapolis, IN (US); Catherine Hidlebaugh, Naples, FL (US); Kathryn M. Dimon, Indianapolis, IN (US)

(73) Assignee: Rolls-Royce Corporation, Indianapolis, IN (US)

( * ) Notice: Subject to any disclaimer, the term of this patent is extended or adjusted under 35 U.S.C. 154(b) by 367 days.

(21) Appl. No.: 14/681,410

(22) Filed: Apr. 8, 2015

(65) Prior Publication Data

US 2016/0010868 A1 Jan. 14, 2016

Related U.S. Application Data

(60) Provisional application No. 62/011,732, filed on Jun. 13, 2014.

(51) Int. Cl.
*F23R 3/48* (2006.01)
*F23R 3/60* (2006.01)

(52) U.S. Cl.
CPC . *F23R 3/48* (2013.01); *F23R 3/60* (2013.01)

(58) Field of Classification Search
CPC ..... F23R 3/48; F23R 3/60
See application file for complete search history.

(56) References Cited

U.S. PATENT DOCUMENTS 2,404,334 A 7/1946 Whittle
2,406,234 A * 8/1946 Marancik et al. ..... F16L 17/10 285/187
2,437,385 A * 3/1948 Halford ..... F23R 3/48 285/121.1
2,525,207 A * 10/1950 Clarke ..... F02C 7/264 60/39.826
2,540,642 A * 2/1951 Allen ..... F02C 7/264 60/39.37
2,679,136 A * 5/1954 Gaubatz ..... F23R 3/48 60/39.37

(Continued)

FOREIGN PATENT DOCUMENTS

EP 2738471 A1 6/2014
GB 347206 4/1931

OTHER PUBLICATIONS

European Office Action, European Application No. 15166865.4-1605, dated Feb. 1, 2017, 5 pages.

(Continued)

*Primary Examiner* — Todd E Manahan
*Assistant Examiner* — Eric Linderman
(74) *Attorney, Agent, or Firm* — Barnes & Thornburg LLP

(57) ABSTRACT

Crossover tubes for use with cans of a turbine engine. The crossover tubes include an outer member, an inner member that is adapted to move collinearly with the outer member. The crossover tubes also include a pair of flanges and a biasing member positioned between the flanges.

17 Claims, 4 Drawing Sheets

(56) References Cited

U.S. PATENT DOCUMENTS 2,722,803 A * 11/1955 Travers ..... F23R 3/48 60/39.37
2,729,938 A * 1/1956 McDowall ..... F23R 3/48 285/19
2,738,471 A * 3/1956 Cassutt ..... H01F 21/005 333/32
2,832,195 A * 4/1958 Weissborn, Jr. ..... F23R 3/48 285/302
2,979,898 A * 4/1961 Ward ..... F23R 3/48 60/39.37
3,001,366 A * 9/1961 Shutts ..... F23R 3/48 285/223
3,184,918 A 5/1965 Mulcahey
3,492,030 A * 1/1970 Lund ..... F16L 27/111 285/300
3,650,106 A * 3/1972 Guillot ..... F02C 7/22 60/39.37
3,721,089 A * 3/1973 Morrison ..... F23R 3/48 285/364
3,811,274 A * 5/1974 Calderon ..... F23R 3/48 60/39.37
3,991,560 A * 11/1976 DeCorso ..... F23R 3/48 60/39.37
4,249,372 A * 2/1981 White ..... F23R 3/48 60/39.37
4,819,970 A * 4/1989 Umehara ..... F16L 11/15 138/121
5,001,896 A * 3/1991 Hilt ..... F23R 3/48 60/39.821
5,154,049 A 10/1992 Ford et al.
5,265,413 A * 11/1993 Cannon ..... F23R 3/48 60/39.37
5,286,071 A * 2/1994 Storage ..... F16L 27/04 285/226
5,361,577 A * 11/1994 Cromer ..... F23R 3/48 285/227
5,398,495 A 3/1995 Ciccia et al.
5,402,635 A * 4/1995 Smith ..... F23R 3/48 60/39.37
5,407,237 A * 4/1995 Smolowitz ..... F01D 9/06 285/114
5,603,531 A * 2/1997 Maier ..... F02K 1/80 285/145.1
5,803,444 A * 9/1998 Shibuya ..... F16F 1/328 267/180
5,896,742 A * 4/1999 Black ..... F23R 3/48 60/39.37
5,964,250 A * 10/1999 Mueller ..... F23R 3/48 138/109
6,220,015 B1 * 4/2001 Mina ..... F23R 3/48 60/39.37
6,334,294 B1 * 1/2002 Belsom ..... F23R 3/48 60/39.37
6,606,865 B2 8/2003 Tilson et al.
7,712,302 B2 5/2010 Nichols et al.
8,418,475 B2 4/2013 Tanimura et al.
9,335,052 B2 * 5/2016 DiCintio ..... F23R 3/48
2003/0079462 A1 * 5/2003 Tilson ..... F23R 3/48 60/39.821
2003/0188537 A1 * 10/2003 Martling ..... F23R 3/48 60/800
2004/0035114 A1 * 2/2004 Hayashi ..... F23R 3/18 60/737
2004/0118121 A1 * 6/2004 Parkman ..... F23R 3/283 60/740
2004/0172952 A1 * 9/2004 Sileo ..... F02C 7/264 60/800
2007/0151260 A1 * 7/2007 Nichols ..... F23R 3/48 60/804
2008/0275619 A1 * 11/2008 Sasao ..... F23N 5/003 701/100
2009/0139241 A1 * 6/2009 Hirata ..... F02C 3/14 60/746
2011/0067406 A1 * 3/2011 Widener ..... F23R 3/48 60/754
2011/0233872 A1 * 9/2011 Iguchi ..... F16J 15/3424 277/400
2012/0047897 A1 * 3/2012 Hirata ..... F23R 3/48 60/737
2013/0126641 A1 * 5/2013 Pfeffer ..... F02C 7/232 239/533.9
2013/0180260 A1 * 7/2013 Romig ..... F02C 7/262 60/776
2014/0130505 A1 * 5/2014 Vandale ..... F23R 3/48 60/772
2014/0137536 A1 * 5/2014 Cloninger ..... F23R 3/48 60/39.37
2014/0144122 A1 * 5/2014 Overby ..... F23R 3/48 60/39.37
2016/0025346 A1 * 1/2016 Hirata ..... F23R 3/286 60/738
2016/0298853 A1 * 10/2016 Boudin ..... F23R 3/48
2017/0059165 A1 * 3/2017 Nanda ..... F23R 3/48
2017/0227228 A1 * 8/2017 Garan ..... F23R 3/46
2017/0284680 A1 * 10/2017 Okazaki ..... F23R 3/48
2018/0023813 A1 * 1/2018 Barton ..... F02C 3/04 60/800
2018/0045416 A1 * 2/2018 Okazaki ..... F23R 3/08
2018/0100654 A1 * 4/2018 Gattermeyer ..... F23R 3/60

OTHER PUBLICATIONS

Extended European Search Report issued in connection with European Application No. 15166865.4-1605, dated Sep. 30, 2015, 8 pages.
European Office Action, European Application No. 15166865.4-1605, dated Nov. 17, 2017, 5 pages.

* cited by examiner

COMBUSTOR WITH SPRING-LOADED CROSSOVER TUBES

CROSS REFERENCE TO RELATED APPLICATIONS

This application claims priority to and the benefit of U.S. Provisional Patent Application No. 62/011,732, filed 13 Jun. 2014, the disclosure of which is now expressly incorporated herein by reference.

FIELD OF THE DISCLOSURE

The present disclosure relates to turbine engines, and in particular to cans in turbine engines. More particularly, the present disclosure relates to crossover tubes that are used to interconnect the cans within the turbine engine.

BACKGROUND

Gas turbine engines are used to power aircraft, watercraft, power generators, pumps and the like. Gas turbine engines typically include a compressor, a combustor, and a turbine. The compressor compresses air drawn into the engine and delivers high pressure air to the combustor. The combustor is typically an assembly that receives the high pressure air from the compressor and adds fuel to the air which is burned to produce hot, high-pressure gas. After burning the fuel, the hot, high-pressure gas is passed from the combustor to the turbine. The turbine extracts work from the hot, high-pressure gas to drive the compressor and residual energy is used for propulsion or to drive an output shaft.

Certain combustor assemblies used in turbine engines include a series of cans arranged around an axis of engine rotation and interconnected by crossover tubes that form passageways between the cans. Each can defines a combustion chamber in which a fuel-air mixture is burned. Burning fuel-air mixture passes through the passageways formed by the crossover tubes to ignite the fuel-air mixture in the adjacent cans.

SUMMARY

The present disclosure may comprise one or more of the following features and combinations thereof.

According to one aspect of the present disclosure, a combustor assembly for use with a turbine engine may include a plurality of cans arranged in a circular pattern and a plurality of crossover tube assemblies used to interconnect the cans. Each can may define a combustion chamber and may include at least two crossover ports opening into the combustion chamber. The plurality of crossover tube assemblies may interconnect the cans at the location of the crossover ports.

In some embodiments, the crossover tube assemblies may each include a crossover tube provided with an annular side wall having a pair of ends and an annular flange that extends radially outwardly from the annular sidewall. A portion of the annular sidewall may be adapted to be positioned within the crossover port of at least one can. The crossover tube assemblies may each also include a biasing member positioned around a portion the crossover tube and adapted to engage the annular flange.

In some embodiments, the crossover tube may include an outer member having the annular sidewall and the flange coupled to one of the ends. The flange may have first and second faces. The crossover tube may also include an inner member having an annular sleeve member, an annular sidewall and a second flange positioned between the annular sleeve member and the annular sidewall of the inner member. The second flange of the inner member may have first and second faces.

In some embodiments, the biasing member may be positioned between the flanges. The inner member may be configured to move collinearly with respect to the outer member and the biasing member may be adapted to bias the flanges away from each other.

In some embodiments, the annular sidewall of the outer member has an inner diameter D1 and the annular sleeve member of the inner member has an outer diameter D3. The diameter D1 may be greater than the diameter D3.

In some embodiments, the annular sidewall of the inner member has an outer diameter D4. The diameter D4 may be greater than diameter D3. The annular sidewall of the outer member has an outer diameter D2 and the diameter D4 may be equal to diameter D2.

In some embodiments, the annular side wall of the crossover tubes may form a passageway between cans such that combustion gases travel from one can, through the passageway of the crossover tube, and to a second can. The biasing member may be located external to the passageway such that combustion gasses traveling through the passageway do not directly contact the biasing member.

According to another aspect of the present disclosure, a crossover tube for use with a can of a turbine engine is taught. The crossover tube may include an outer member and an inner member. The outer member may have an annular sidewall with first and second ends and a first flange coupled to one of the ends. The first flange may have first and second faces. The inner member may have an annular sleeve member, an annular sidewall and a second flange positioned between the annular sleeve member and the annular sidewall of the inner member. The second flange of the inner member may have first and second faces.

In some embodiments, the crossover tube may include a biasing member. The biasing member may be positioned around the annular sleeve member and between the first and second flanges. The biasing member may be adapted to engage a face of the first and second flanges. The inner member may be configured to move collinearly with respect to the outer member and the biasing member may be adapted to bias the first flange away from the second flange.

In some embodiments, the annular sidewall of the outer member has an inner diameter D1 and the annular sleeve member of the inner member has an outer diameter D3. The diameter D1 may be greater than the diameter D3.

In some embodiments, the annular sidewall of the inner member has an outer diameter D4. The diameter D4 may be greater than diameter D3. The annular sidewall of the outer member has an outer diameter D2 and the diameter D4 may be equal to diameter D2.

In some embodiments, the annular sleeve member of the inner member may be adapted to slide within the annular sidewall of the outer member. The biasing member may be in the form of a wave spring that is adapted to be positioned over the annular sleeve member of the inner member of the crossover tube. The wave spring may be adapted to engage the first and second flanges.

According to another aspect of the present disclosure, a turbine engine may include a plurality of cans and a plurality of crossover tubes. The plurality of cans may be arranged in a circular pattern. Each can may include at least two crossover ports that allow for the ingress and egress of combustion gasses. The plurality of crossover tubes may be adapted to be coupled to the crossover ports to interconnect the cans. The crossover tubes may include an annular side wall having a pair of ends and an annular flange that extends radially outwardly from the annular side wall. A portion of the annular sidewall may be adapted to be positioned within the crossover ports of adjacent cans.

In some embodiments, the crossover tubes may each include a biasing member positioned around a portion the annular side wall and adapted to engage the annular flange. The crossover tubes may each include an outer member having an annular sidewall with first and second ends and the flange coupled to one of the ends. The flange may have first and second faces In some embodiments, the crossover tubes may each also include an inner member having an annular sleeve member, an annular sidewall and a second flange positioned between the annular sleeve member and the annular sidewall of the inner member. The second flange of the inner member may have first and second faces. The biasing member may be positioned between the flanges These and other features of the present disclosure will become more apparent from the following description of the illustrative embodiments.

BRIEF DESCRIPTION OF THE DRAWINGS

The detailed description particularly refers to the accompanying figures in which.

DETAILED DESCRIPTION

Figure 1:
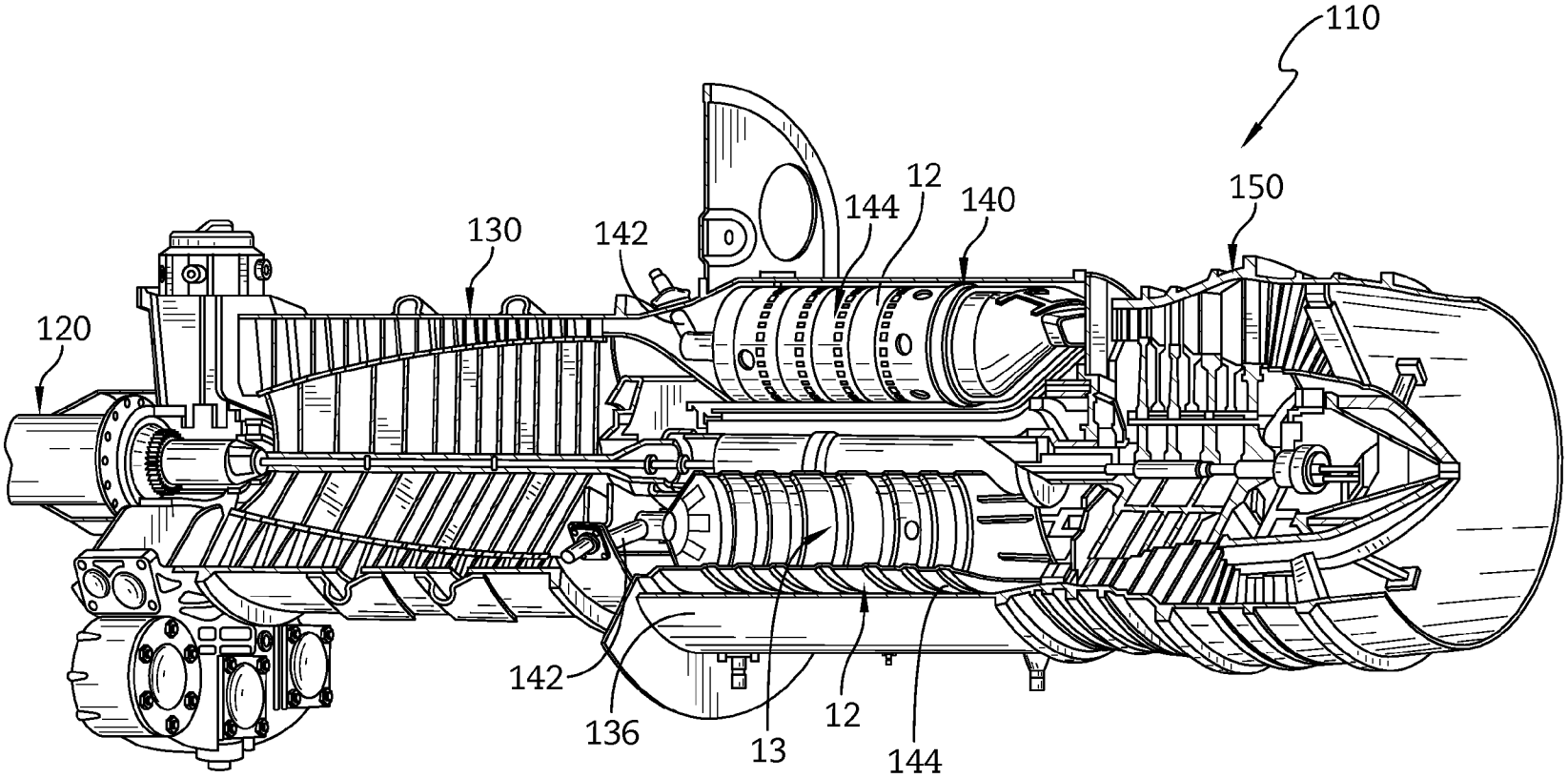
FIG. 1 is a perspective view of a turbine engine with portions cut away to show that the engine includes a can-type combustor assembly.

The arrangement of an illustrative combustor assembly 140 in a gas turbine engine 110 is shown in FIG. 1. The gas turbine engine 110 includes an output shaft 120, a compressor 130, the combustor assembly 140, and a turbine 150. The output shaft 120 is driven by the turbine 150 and may drive a propeller, a gearbox, a pump, or the like (not shown) depending on the application of the gas turbine engine 110. The compressor 130 compresses and delivers air to the combustor assembly 140. The combustor assembly 140 mixes fuel with the compressed air received from the compressor 130 and ignites the fuel. The hot, high pressure products of the combustion reaction in the combustor assembly 140 are directed into the turbine 150 and the turbine 150 extracts work to drive the compressor 130 and the drive shaft 120.

Figure 2:
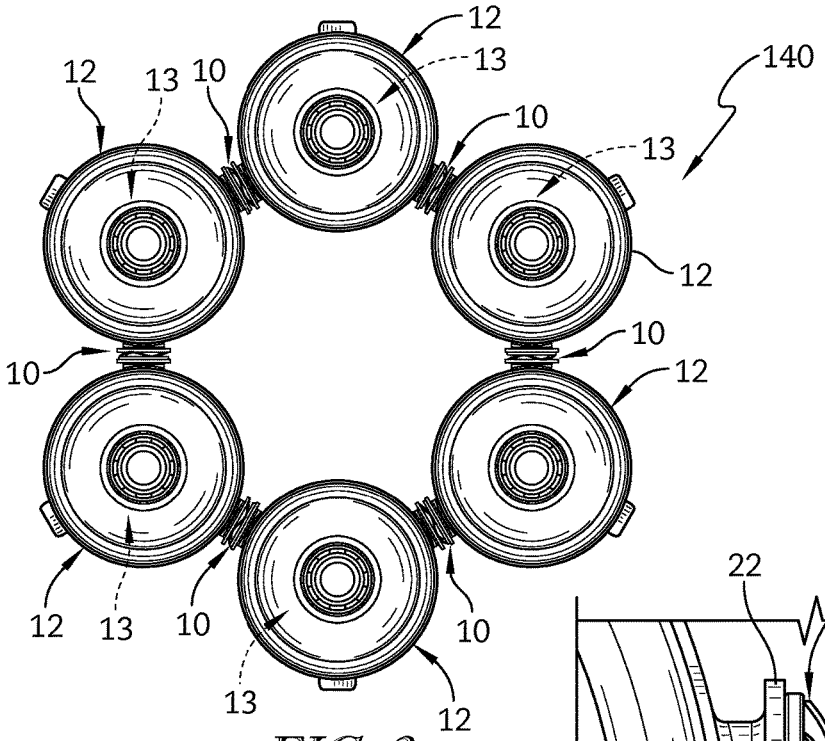
FIG. 2 is an end view of the can-type combustor assembly showing six cans included in the combustor arranged in a circular pattern with crossover tubes positioned between and interconnecting the cans.

The combustor assembly 140 is of the can-type and includes a number of individual cans 12 and a number of crossover tubes 10 as shown in FIG. 2. Each can 12 defines a combustion chamber 13 in which a fuel-air mixture is burned. Crossover tubes 10 of the present disclosure are positioned between and are used to interconnect the combustion chambers 13 of cans 12 as suggested, for example in FIGS. 1 and 2. In the illustrative embodiment, each crossover tube 10 includes a biasing member 40 that accommodates movement of adjacent cans 12 included in the same combustor assembly 140 during operation of a gas turbine engine 110.

Cans 12 are self-contained cylindrical combustion chambers, as shown, for example, in FIG. 1. Each can 12 typically includes a fuel nozzle 142 and a liner 144 mounted to a combustor casing 136. Some of the cans 12 may include an igniter (not shown) used to ignite the fuel atomized by the fuel nozzles 142. Fuel in cans 12 without igniters are ignited through the use of crossover tubes 10. For the purpose of initial ignition and continuous combustion, it has become customary to join the interiors of adjacent cans 12 through crossover tubes 10, so that when ignition occurs in one of the cans 12, a burning fuel-air mixture will pass through the crossover tubes 10 to ignite the fuel-air mixture in the adjacent cans 12.

Figure 3:
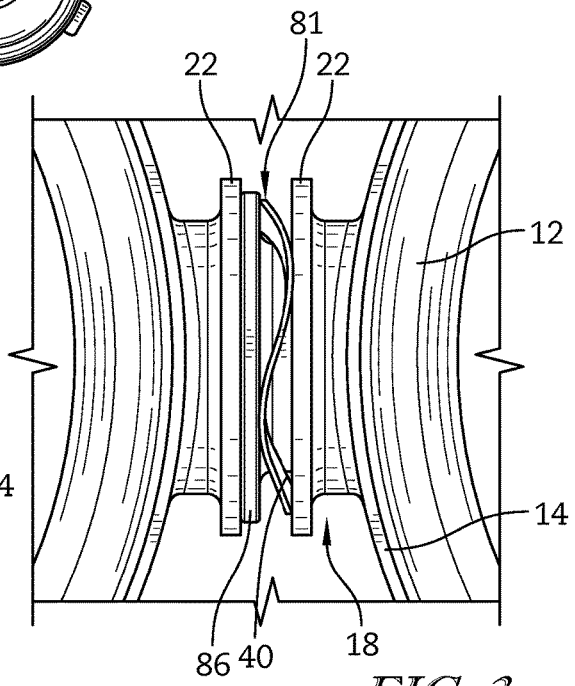
FIG. 3 is an enlarged view of two adjacent cans of FIG. 2 showing a crossover tube interconnecting two cans.
Figure 4:
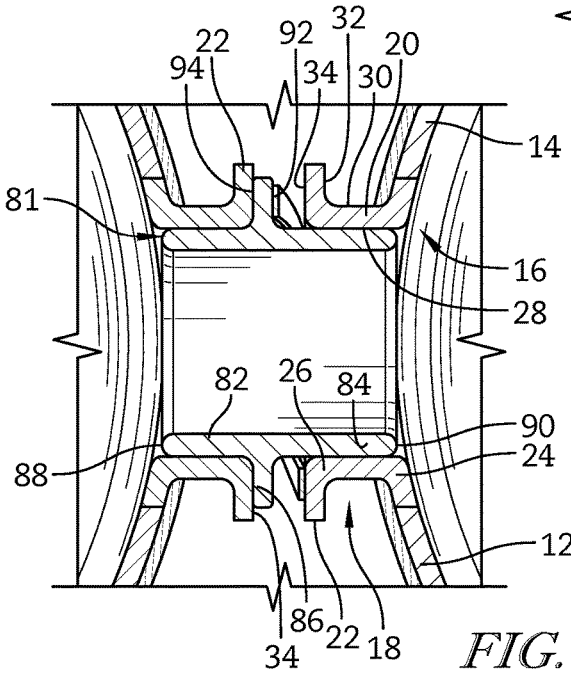
FIG. 4 is a sectional view of FIG. 3 showing the crossover tube positioned between the cans.

Crossover tubes 10 are adapted to interconnect cans 12, as shown in FIGS. 3 and 4. Cans 12 include a cylindrical side wall 14 that is provided with openings 16 or ports formed by annular crossover ferrules 18. Crossover ferrules 18 include an annular sidewall 20 and an annular flange 22 that is perpendicularly oriented to the annular sidewall 20.

Annular sidewall 20 of crossover ferrule 18 is coupled to the side wall 14 of the can 12 at a first end 24 and to annular flange 22 at a second end 26. Annular sidewall 20 includes an inside surface 28 and an outside surface 30 that is greater than the inside surface 28. Inside surface 28 is positioned against a portion of crossover tube 10 when crossover tube 10 is positioned within crossover ferrule 18 during assembly.

Annular flange 22 of crossover ferrules 18 are relatively planar and include a first face 32 and an opposing second face 34. First face 32 faces towards can 12 and is coupled to annular sidewall 20. Second face 32 of annular flange 22 faces away from can 12 and forms an engagement surface for at least a portion of crossover tubes 10. Second face 34 of annular flange 22 faces the second face 34 of an annular flange 22 of an adjacent can 12.

Figure 6:
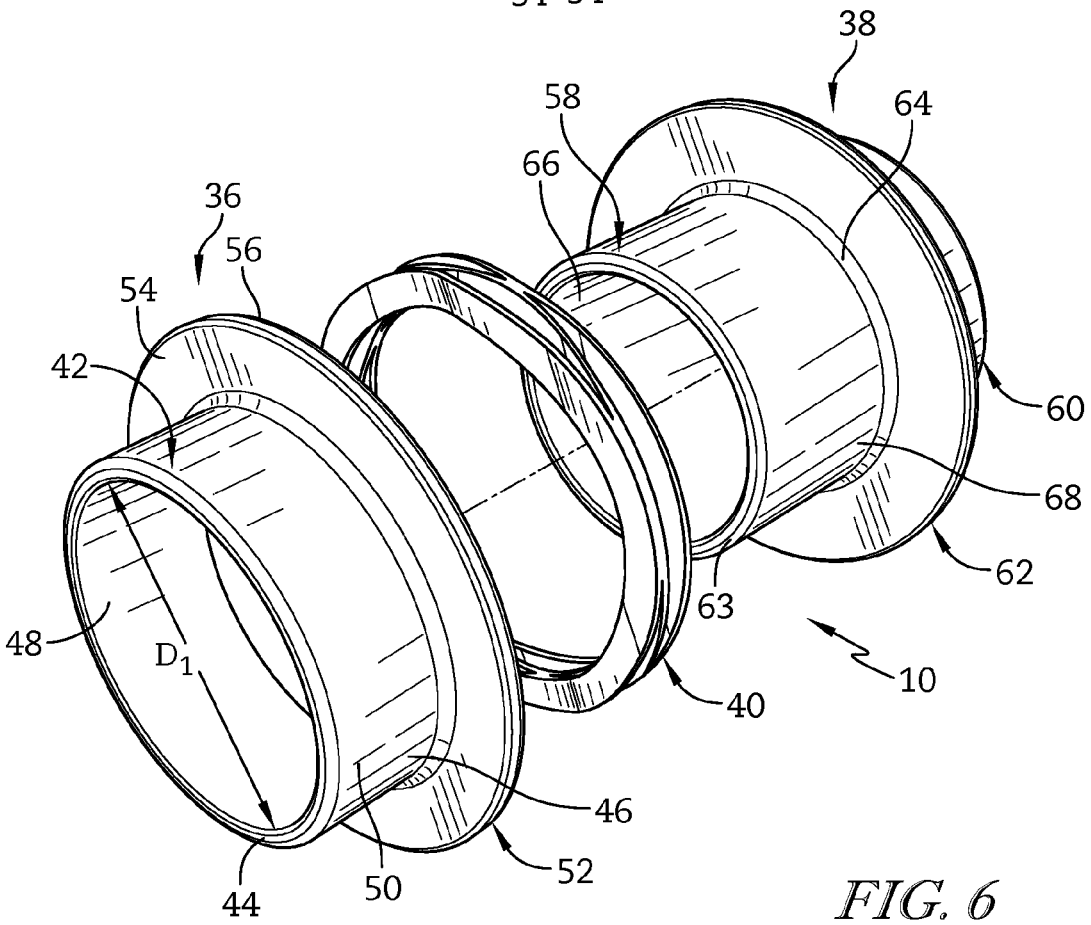
FIG. 6 is an exploded perspective view of another embodiment of a crossover tube assembly.

Crossover tube 10 includes an assembly of components as shown, for example, in FIG. 6. Crossover tube 10 includes an outer member 36, an inner member 38 that is telescopically received in outer member 36 and a biasing member 40 positioned between outer and inner members 36, 38.

Figure 7:
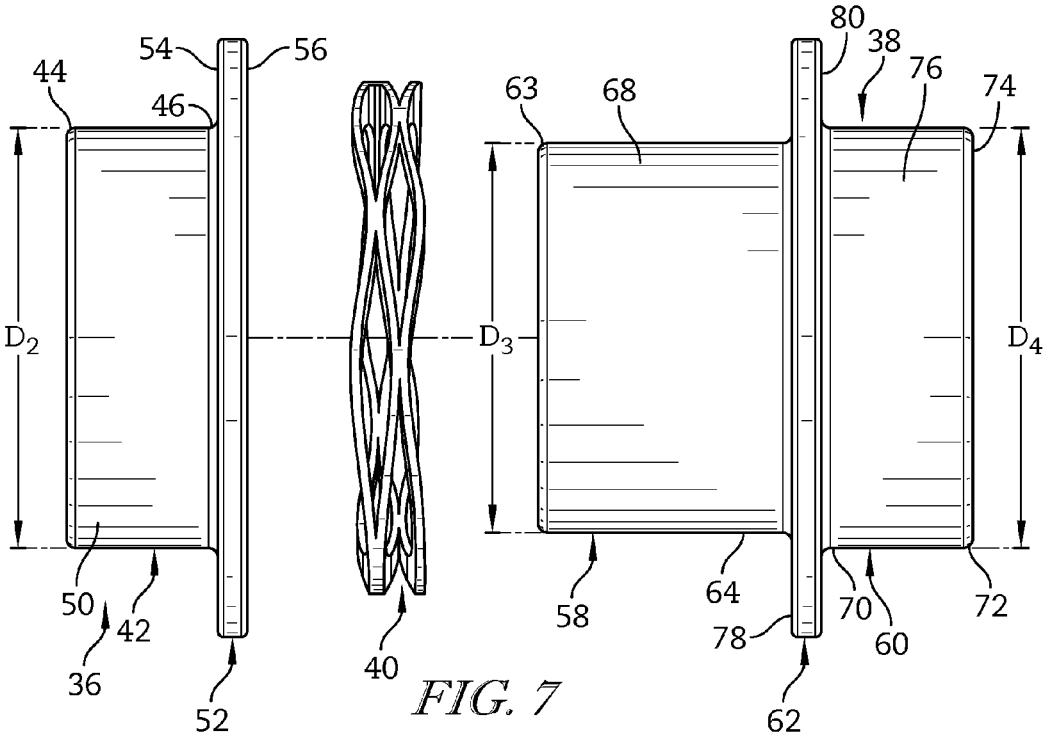
FIG. 7 is an exploded side elevational view of the crossover tube assembly of FIG. 6.

Outer member 36 of crossover tube 10 includes an annular side wall 42, as shown in FIGS. 6 and 7. Annular side wall 42 includes a first end 44 and a spaced apart second end 46. Annular side wall 42 also includes an inside surface 48 and a spaced apart outer surface 50. Annular sidewall 42 has an inner diameter D1 and an outer diameter D2 that is greater than inner diameter D1.

Outer member 36 of crossover tube 10 also includes an annular flange 52 that is coupled to the second end 46 of annular side wall 42. Annular flange 52 extends radially outwardly from outer surface 50 of annular side wall 42 and includes a first face 54 and a spaced apart second face 56. Second face 56 of annular flange 52 is adapted to engage biasing member 40 to provide a support surface for biasing member 40. Outer member 36 of crossover tube 10 is preferably machined as a single piece and preferably made from a high temperature metal alloy such as a nickel based cobalt alloy or other alloys that exhibit good high temperature and wear resistance.

Inner member 38 of crossover tube 10 is configured to telescopingly engage outer member 36 and both are adapted to move collinearly with respect to each other. Inner member 38 includes an annular sleeve member 58, an annular side wall 60 and an annular flange 62 positioned between sleeve member 58 and annular side wall 60. Sleeve member 58 is adapted to be positioned within annular side wall 42 of outer member 36.

Figure 8:
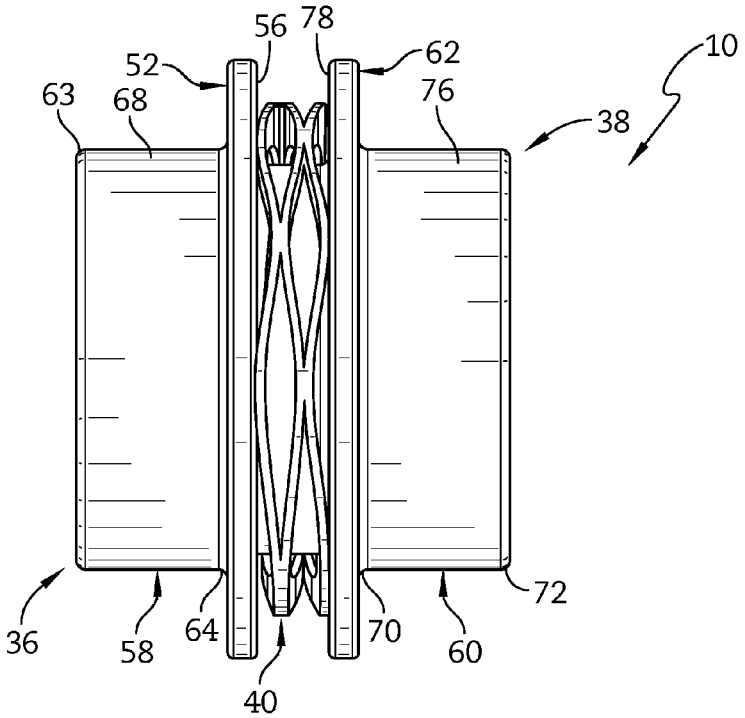
FIG. 8 is a side elevational view of the crossover tube assembly of FIGS. 6 and 7 in the assembled position.

Annular sleeve member 58 of inner member 38 is tubular in shape and includes a first end 63 and a spaced apart second end 64, as shown in FIGS. 6 and 7. Sleeve member 58 includes an inner surface 66 and an outer surface 68. Sleeve member 58 has an outer diameter D3 that is less than diameter D1 of annular side wall 42 of outer member 36 to allow sleeve member 58 to fit inside of annular side wall 42, as shown in FIG. 8. The gap between outer surface 68 of sleeve member 58 and inner surface 48 of annular side wall 42 is between 0.001" and 0.004" and preferably between 0.001" and 0.002" to permit linear movement between the two components, while limiting unwanted blow by of combustion gasses.

Annular side wall 60 of inner member 38 includes a first end 70 and a spaced apart second end 72, as shown in FIG. 7. Annular side wall 60 also includes an inner surface 74 and an outer surface 76. Annular side wall 60 has an outer diameter D4, which is greater than outer diameter D3 of sleeve member 58. Outer diameter D4 of annular side wall 60 is the same diameter as outer diameter D2 of annular side wall 42. Annular side wall 60 is adapted to be inserted into crossover ferrule 18 of can 12. Once inserted, outer surface 76 of annular side wall 60 is positioned adjacent inside surface 28 of crossover ferrule 18.

Annular flange 62 of inner member 38 is positioned between annular side wall 60 and sleeve member 58, as shown in FIG. 7. Annular flange 62 is positioned at second end 64 of sleeve member 58 and at first end 70 of annular side wall 60. Annular flange 62 of inner member 38 includes a first face 78 and a spaced apart second face 80. First face 78 of inner member 38 is adapted to face second face 56 of annular flange 52 of outer member 36. Inner member 36 of crossover tube 10 is preferably machined as a single piece and preferably made from a high temperature alloy such as a nickel based cobalt alloy or other alloys that exhibit good high temperature and wear resistance.

Biasing member 40 is designed to allow for movement between inner member 38 and outer member 36 and maintains force against flanges 52, 62 to secure flanges 52, 62 against crossover ferrules 18. Biasing member 40 is in the form of a compression spring such as a coil spring and is preferably a single turn wave spring or a nested wave spring.

A wave spring, also known as a coiled wave spring, a disc spring, or a scrowave spring, is a spring made from pre-hardened flat wire in a process called, on-edge-coiling, also known as edge winding. During this process, waves are added to give it a spring effect. The number of turns and waves can be adjusted to accommodate stronger force.

A wave spring has the following advantages over a traditional coiled spring or a washer. The axial space can be reduced by 50% versus a coil spring. As a result, an overall size of the crossover tube assembly becomes smaller and thus significant weight reduction. Further, the load in an axial direction is 100% transferable.

Use of a wave spring as a biasing member allows the crossover tube assembly 10 to accommodate higher thrust load within the limited axial space as only elements such as the size of the wire, the number of waves, the height of waves, and the number of turns need to be adjusted to accommodate such high thrust loads. Biasing member 40 is preferably made from a nickel based alloy or a stainless alloy for heat resistance. Location of biasing member 40 with respect to outer and inner members 36, 38 protect biasing member 40 from hot combustion gasses. The reduction in heat exposure significantly increases the life of biasing member 40 and reduces metal fatigue.

Figure 5:
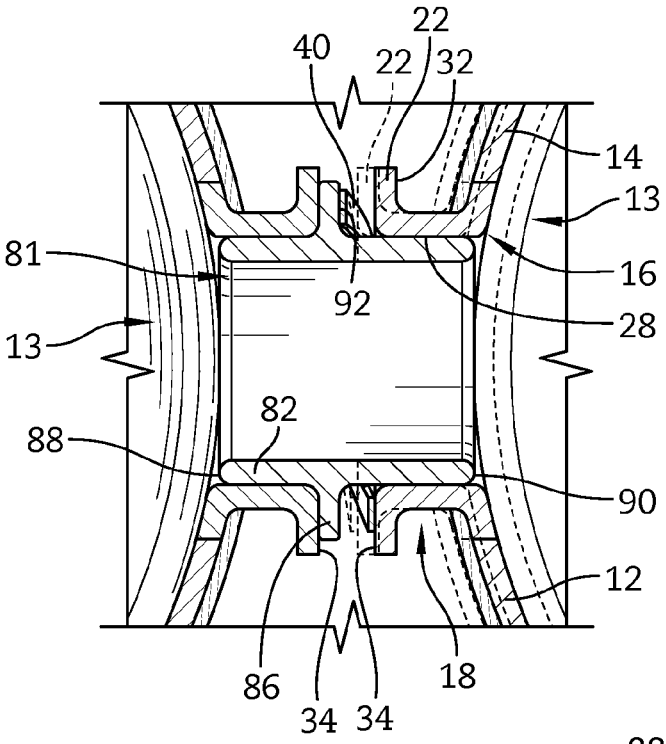
FIG. 5 is a sectional view similar to the sectional view of FIG. 4 showing movement of the right can with respect to the left can and deflection of a biasing member.

In another embodiment, crossover tube 81 can be a one piece design, as shown in FIGS. 3-5, as opposed to the two piece design shown in FIGS. 6-8, which include outer and inner members 36, 38. In this embodiment, crossover tube 10 includes a first annular side wall section 82, a second annular side wall section 84 and an annular flange 86. First annular side wall section 82 is shorter in axial length than second annular side wall section 84 so that annular flange 86 is closer to first end 88 than to second end 90.

Annular flange 86 of crossover tube 81, includes a first face 92 and a spaced apart second face 94. When assembled with can 12, first annular side wall section 82 is positioned within a first ferrule 18 of a first can 12 and second annular side wall section 84 is positioned within a second ferrule 18 of a second can 12, as shown, for example in FIGS. 3-5. Movement of the first can 12 and ferrule 18 toward the second can 12 and ferrule 18 causes movement of the second annular side wall section 84 with respect to the ferrule 18 and compression of biasing member 40, as shown in FIG. 5.

Both crossover tube designs 10, 81 make assembling the cans 12 easier. This is because biasing member 40 of crossover tube compensates for errors in manufacturing tolerances in the cans 12 and ferrules 18 so that spacer washers do not need to be used to take up any unwanted gaps between annular flanges 22 of adjacent ferrules 18. Also, during operation of the engine, heat expansion of the metal and vibration caused by engine operation is absorbed by the crossover tubes and biasing member 40, which reduces wear to cans 12 and ferrules 18. The crossover tube design also controls airflow leakage at the crossover interface between cans 12.

While the disclosure has been illustrated and described in detail in the foregoing drawings and description, the same is to be considered as exemplary and not restrictive in character, it being understood that only illustrative embodiments thereof have been shown and described and that all changes and modifications that come within the spirit of the disclosure are desired to be protected.

What is claimed is:

1. A combustor assembly for use with a turbine engine, the combustor assembly comprising:

a plurality of cans arranged in a circular pattern, each can defining a combustion chamber and including at least two crossover ports opening into the combustion chamber;

a plurality of crossover tube assemblies used to interconnect the plurality of cans at the location of the at least two crossover ports, the plurality of crossover tube assemblies each including a monolithic crossover tube provided with an annular side wall having a first end, a second end opposite the first end, and an annular flange that extends radially outwardly from the annular side wall, the first end of the annular side wall of the one-piece crossover tube is positioned within the respective crossover port of a first can and the second end of the annular side wall of the monolithic crossover tube is positioned within the respective crossover port of a second can; and each of the plurality of crossover tube assemblies also including a biasing member positioned to surround a portion of the one-piece crossover tube and adapted to directly engage the annular flange.

2. The combustor assembly of claim 1, wherein the annular flange is spaced apart from the first end and the second end included in the annular side wall, the annular flange having a first and a second face.

3. The combustor assembly of claim 1, wherein the annular side wall of the monolithic crossover tube forms a passageway between the first and second can such that combustion gases travel from the first can, through the passageway of the monolithic crossover tube and to the second can.

4. The combustor assembly of claim 3, wherein the biasing member is located external to the passageway such that combustion gasses traveling through the passageway do not directly contact the biasing member.

5. A turbine engine comprising:

a plurality of cans arranged in a circular pattern, each can including at least two crossover ports that allow for the ingress and egress of combustion gasses;

a plurality of crossover tubes adapted to be coupled to the plurality of crossover ports to interconnect the plurality of cans;

the plurality of crossover tubes each including a single, monolithic annular side wall having an annular flange that extends radially outwardly from the single, monolithic annular side wall and the single, monolithic annular side wall is positioned within the plurality of crossover ports of adjacent cans; and the plurality of crossover tubes each including a biasing member positioned to surround a portion the single, monolithic annular side wall and adapted to directly engage the annular flange.

6. The turbine engine of claim 5, wherein the single, monolithic annular side wall includes a pair of ends and the annular flange is spaced apart from the pair of ends, the annular flange having a first and second face.

7. A combustor assembly for use with a turbine engine, the combustor assembly comprising:

a plurality of cans arranged in a circular pattern, each can defining a combustion chamber, each can includes a cylindrical side wall provided with openings formed by annular crossover ferrules, each annular crossover ferrule includes an annular ferrule side wall and an annular ferrule flange that is perpendicularly oriented to the annular ferrule side wall of the annular crossover ferrule, and a monolithic crossover tube that includes an annular side wall, the annular side wall including a first annular side wall section, a second annular side wall section opposite the first annular side wall section and fixed relative to the first annular side wall section for movement therewith, and an annular flange located between the first annular side wall section and the second annular side wall section, the first annular side wall section positioned within a first crossover ferrule of a first can, and the second annular side wall section positioned within a second crossover ferrule of a second can adjacent to the first can such that the monolithic crossover tube extends between and is positioned within the first can and the second can;

further comprising a biasing member positioned to surround the monolithic crossover tube and adapted to directly engage the annular flange of the monolithic crossover tube.

8. The combustor assembly of claim 7, wherein the first annular side wall section is shorter in axial length than the second annular side wall section.

9. The combustor assembly of claim 8, wherein the annular side wall of each crossover ferrule is spaced apart from the cylindrical side wall of the corresponding can.

10. The combustor assembly of claim 9, wherein the biasing member includes a wave spring.

11. The combustor assembly of claim 7, wherein the annular flange of the monolithic crossover tube engages the annular flange of the other of the one of the first and second crossover ferrules.

12. The combustor assembly of claim 8, wherein the annular flange of the monolithic crossover tube is spaced apart from a pair of ends of the monolithic crossover tube.

13. The combustor assembly of claim 7, wherein the annular side wall of each crossover ferrule is spaced apart from the cylindrical side wall of the corresponding can and wherein the annular side wall of the crossover ferrule is perpendicular to the annular flange of the annular side wall included in the monolithic crossover tube.

14. The combustor assembly of claim 13, wherein the biasing member includes a wave spring.

15. The combustor assembly of claim 13, wherein the biasing member engages the annular flange of one of the first and second crossover ferrules- and the annular flange of the monolithic crossover tube engages the annular flange of the other of the one of the first and second crossover ferrules.

16. The combustor assembly of claim 7, wherein the monolithic crossover tube is positioned against the annular side wall of the crossover ferrule for sliding engagement therewith.

17. The combustor assembly of claim 7, wherein the monolithic crossover tube extends across the span of the crossover ferrule and wherein the first annular side wall section of the monolithic crossover tube ends along an outer circumference of the first can and the second annular side wall section of the monolithic crossover tube ends along an outer circumference of the second can.

* * * * *